US010193268B1

(12) United States Patent
Chow et al.

(10) Patent No.: US 10,193,268 B1
(45) Date of Patent: Jan. 29, 2019

(54) SFP CABLE CONNECTOR CAPABLE OF PROTECTING SOLDER JOINTS

(71) Applicant: Teralux Technology Co., Ltd., Kunshan (CN)

(72) Inventors: Min-Chan Chow, Kunshan (CN); Jin Hua Meng, Kunshan (CN)

(73) Assignee: TERALUX TECHNOLOGY CO., LTD., Kunshan (CN)

( * ) Notice: Subject to any disclaimer, the term of this patent is extended or adjusted under 35 U.S.C. 154(b) by 0 days.

(21) Appl. No.: 15/798,426

(22) Filed: Oct. 31, 2017

(51) Int. Cl.

| | |
|---|---|
| ***H01R 13/516*** | (2006.01) |
| ***H01R 13/40*** | (2006.01) |
| ***H01R 12/72*** | (2011.01) |
| ***H01R 12/53*** | (2011.01) |

(52) U.S. Cl.
CPC ..... *H01R 13/516* (2013.01); *H01R 12/53* (2013.01); *H01R 12/72* (2013.01); *H01R 13/40* (2013.01)

(58) Field of Classification Search
CPC ..... H01R 13/516; H01R 13/6658
See application file for complete search history.

(56) References Cited

U.S. PATENT DOCUMENTS 6,617,939 B1 * 9/2003 Vermeersch ..... H01R 13/719 333/28 R
7,056,156 B1 * 6/2006 Hanley ..... H01R 13/6596 439/677
7,147,502 B1 * 12/2006 Wu ..... H01R 13/6275 439/352
7,160,135 B1 * 1/2007 Wu ..... H01R 13/512 439/160
7,207,823 B1 * 4/2007 Yang ..... H01R 13/6275 439/352
7,223,915 B2 * 5/2007 Hackman ..... H01R 13/6658 174/36
7,232,329 B1 * 6/2007 Wu ..... H01R 12/62 439/358
7,238,040 B1 * 7/2007 Wu ..... H01R 13/6275 439/352
7,297,028 B2 * 11/2007 Daikuhara ..... G02B 6/4246 439/577
7,494,363 B1 * 2/2009 Wu ..... H01R 13/6275 439/352
7,520,757 B2 * 4/2009 Bartholomew ..... H05K 1/0219 439/76.1
7,540,755 B1 * 6/2009 Wu ..... H01R 13/6275 439/352

(Continued)

FOREIGN PATENT DOCUMENTS

CN 202362501 U 8/2012

*Primary Examiner* — Ross Gushi
(74) *Attorney, Agent, or Firm* — JMB Davis Ben-David

(57) ABSTRACT

An SFP cable connector capable of protecting solder joints includes a lower case, a cable, a circuit board that is soldered with one end of the cable to form a plurality of solder joints, an insulator being formed on the circuit board and covering said solder joints, and an upper case being mounted on the lower case and being capable of pressing the insulator. The SFP cable connector can provide a direct protection for said solder joints by employing the upper case to press the insulator downward, thereby preventing said solder joints between the cable and the circuit board from being damaged and ensuring the quality of the SFP cable connector.

9 Claims, 7 Drawing Sheets

(56) References Cited

U.S. PATENT DOCUMENTS 7,559,785 B1 * 7/2009 Wu ..... H01R 13/6275 439/352
7,559,800 B2 * 7/2009 Wu ..... H01R 13/6584 439/607.3
7,690,939 B2 * 4/2010 Wu ..... H01R 9/032 439/160
7,771,225 B1 * 8/2010 Wu ..... H01R 9/032 439/352
7,841,887 B2 * 11/2010 Zhang ..... G02B 6/4246 439/352
7,938,669 B2 * 5/2011 Li ..... H01R 13/6275 439/352
7,955,003 B2 * 6/2011 Teo ..... H01R 13/6275 385/88
7,957,159 B2 * 6/2011 Wu ..... H01R 13/6584 361/818
7,997,909 B2 * 8/2011 Xu ..... H01R 13/6594 439/607.57
8,035,975 B2 * 10/2011 Wu ..... H01R 13/6335 361/727
8,047,865 B2 * 11/2011 Patel ..... H01R 13/6658 439/466
8,057,260 B2 * 11/2011 Zhu ..... H01R 13/6658 439/607.41
8,062,052 B2 * 11/2011 Wu ..... H01R 13/6272 439/352
8,064,207 B2 * 11/2011 Wu ..... G06K 13/08 361/726
8,147,255 B2 * 4/2012 Wu ..... H01R 13/6658 439/358
8,251,733 B2 * 8/2012 Wu ..... H01R 13/512 439/160
8,251,735 B2 * 8/2012 Wu ..... H01R 13/5825 439/353
8,267,718 B2 * 9/2012 Straka ..... H01R 9/034 439/497
8,337,243 B2 * 12/2012 Elkhatib ..... H01R 12/594 439/581
8,353,707 B2 * 1/2013 Wang ..... H01R 13/6658 439/60
8,360,799 B2 * 1/2013 Wu ..... H01R 13/6581 439/358
8,388,366 B2 * 3/2013 Yang ..... H01R 13/6335 439/357
8,439,706 B2 * 5/2013 Sytsma ..... H01R 13/65802 439/607.19
8,475,198 B2 * 7/2013 Wu ..... H01R 13/6275 439/352
8,475,210 B2 * 7/2013 Wang ..... H01R 13/6658 439/607.31
8,480,432 B2 * 7/2013 Wu ..... H01R 13/5812 439/353
8,506,331 B2 * 8/2013 Wu ..... H01R 13/6658 439/353
8,523,598 B2 * 9/2013 Wu ..... H01R 13/6658 439/352
8,537,558 B2 * 9/2013 Su ..... H01R 9/032 361/740
8,550,848 B2 * 10/2013 Wu ..... H01R 13/6583 439/353
8,562,373 B2 * 10/2013 Wu ..... H01R 13/6335 439/352
8,597,045 B2 * 12/2013 Zhu ..... H01R 13/506 439/357
8,599,567 B2 * 12/2013 Wu ..... G02B 6/4261 361/752
8,614,398 B2 * 12/2013 Regnier ..... H01R 13/6658 174/261
8,662,917 B2 * 3/2014 Wang ..... H01R 9/038 439/493
8,668,515 B2 * 3/2014 Wu ..... H01R 13/633 439/352
8,740,637 B2 * 6/2014 Wang ..... H01R 13/6335 439/352
8,770,990 B2 * 7/2014 Sytsma ..... H01R 9/034 439/76.1
8,787,025 B2 * 7/2014 Wu ..... H01R 13/6275 361/740
8,834,185 B2 * 9/2014 Wu ..... H01R 9/2408 439/76.1
8,870,598 B2 * 10/2014 Qi ..... H01R 13/6581 439/620.03
8,905,777 B2 * 12/2014 Zhu ..... H01R 13/62 439/352
8,911,256 B2 * 12/2014 Qiao ..... H01R 13/6581 439/607.18
8,926,339 B2 * 1/2015 Houtz ..... H01R 13/5045 439/76.1
8,926,347 B2 * 1/2015 Zhu ..... H01R 13/62 439/159
8,979,553 B2 * 3/2015 Lloyd ..... H01R 12/53 439/76.1
8,986,036 B2 * 3/2015 Lindkamp ..... G02B 6/4246 439/160
9,071,003 B2 * 6/2015 Lindkamp ..... H01R 13/50
9,077,107 B2 * 7/2015 Lloyd ..... H01R 13/6275
9,203,171 B2 * 12/2015 Yu ..... H01R 12/73
9,203,193 B2 * 12/2015 Hackman ..... H01R 13/648
9,246,262 B2 * 1/2016 Brown ..... H01R 13/62
9,337,590 B2 * 5/2016 Wu ..... H01R 13/6473
9,373,915 B1 * 6/2016 Schulz ..... H01R 13/6594
9,419,367 B2 * 8/2016 Henry ..... H01R 9/034
9,466,925 B2 * 10/2016 Rost ..... H01R 9/032
9,478,910 B2 * 10/2016 Nonen ..... H01R 13/6275
9,553,390 B2 * 1/2017 Lu ..... H01R 13/46
9,560,752 B2 * 1/2017 Wu ..... H05K 1/0298
9,671,582 B2 * 6/2017 Yeh ..... H04B 10/40
9,748,694 B2 * 8/2017 Nonen ..... H01R 13/6273
9,774,113 B2 * 9/2017 Zhang ..... H01R 12/594
9,774,146 B2 * 9/2017 Cheng ..... H01R 13/665
9,799,981 B2 * 10/2017 Weber ..... H01R 13/6275
9,882,306 B2 * 1/2018 Pao ..... H01R 12/53
2006/0121794 A1 * 6/2006 Hanley ..... H01R 13/6596 439/677
2006/0252311 A1 * 11/2006 Togami ..... G02B 6/4277 439/607.2
2007/0117458 A1 * 5/2007 Winker ..... G02B 6/4201 439/607.01
2007/0123090 A1 * 5/2007 Kim ..... G02B 6/4201 439/372
2007/0161281 A1 * 7/2007 Wu ..... H01R 13/6275 439/352
2007/0232091 A1 * 10/2007 Hong ..... H05K 1/117 439/66
2009/0137138 A1 * 5/2009 Ohsumi ..... H01R 13/4538 439/137
2009/0147493 A1 * 6/2009 Wu ..... H01R 13/6584 361/818
2009/0156058 A1 * 6/2009 Wu ..... H01R 13/6584 439/607.18
2009/0227133 A1 * 9/2009 Zhang ..... G02B 6/4246 439/160
2009/0291578 A1 * 11/2009 Wu ..... H01R 9/032 439/258
2010/0029104 A1 * 2/2010 Patel ..... H01R 13/6658 439/76.1
2010/0091466 A1 * 4/2010 Wu ..... G06K 13/08 361/747
2010/0091467 A1 * 4/2010 Wu ..... H01R 13/6335 361/747
2010/0210142 A1 * 8/2010 McGrath ..... H01R 12/594 439/620.22
2010/0248544 A1 * 9/2010 Xu ..... H01R 13/6658 439/607.04
2010/0330841 A1 * 12/2010 Zhang ..... H01R 9/034 439/607.41
2011/0003502 A1 * 1/2011 Li ..... H01R 9/03 439/464

(56) References Cited

U.S. PATENT DOCUMENTS

2011/0034082 A1* 2/2011 Zhu ..... H01R 13/6658 439/607.41
2011/0059645 A1* 3/2011 Wu ..... H01R 9/032 439/460
2011/0081114 A1* 4/2011 Togami ..... G02B 6/4246 385/76
2011/0086548 A1* 4/2011 Wu ..... H01R 9/032 439/607.41
2011/0136368 A1* 6/2011 Wu ..... H01R 13/506 439/345
2011/0183535 A1* 7/2011 Wu ..... H01R 13/5825 439/153
2011/0195586 A1* 8/2011 Wu ..... H01R 13/512 439/152
2011/0195590 A1* 8/2011 Wu ..... H01R 13/6581 439/345
2011/0195595 A1* 8/2011 Wu ..... H01R 13/6275 439/370
2011/0237112 A1* 9/2011 Wu ..... H01R 13/6275 439/358
2011/0250791 A1* 10/2011 Straka ..... H01R 9/034 439/607.09
2011/0279984 A1* 11/2011 Su ..... H01R 13/6582 361/736
2011/0281455 A1* 11/2011 Wu ..... H01R 13/5825 439/345
2011/0287642 A1* 11/2011 Wang ..... H01R 9/031 439/83
2011/0300735 A1* 12/2011 Wu ..... H01R 13/6275 439/345
2011/0304996 A1* 12/2011 Wu ..... G02B 6/4261 361/752
2011/0306244 A1* 12/2011 Zhang ..... H01R 9/034 439/624
2012/0015544 A1* 1/2012 Wu ..... H01R 13/6275 439/345
2012/0015545 A1* 1/2012 Wu ..... H01R 13/5825 439/345
2012/0040545 A1* 2/2012 Wang ..... H01R 13/635 439/157
2012/0040550 A1* 2/2012 Wu ..... H01R 13/6275 439/352
2012/0040551 A1* 2/2012 Wu ..... H01R 13/6275 439/358
2012/0040552 A1* 2/2012 Wu ..... H01R 13/6581 439/358
2012/0040560 A1* 2/2012 Wang ..... H01R 13/6658 439/607.31
2012/0040569 A1* 2/2012 Wang ..... H01R 13/6658 439/676
2012/0052712 A1* 3/2012 Wang ..... H01R 13/6275 439/352
2012/0058651 A1* 3/2012 Wang ..... H01R 13/6275 439/76.1
2012/0058652 A1* 3/2012 Wang ..... H01R 13/6275 439/76.1
2012/0058665 A1* 3/2012 Zerebilov ..... H01R 13/6275 439/370
2012/0063100 A1* 3/2012 Su ..... H01R 9/032 361/747
2012/0064750 A1* 3/2012 Wu ..... H01R 13/5812 439/345
2012/0094515 A1* 4/2012 Wu ..... H01R 13/6272 439/159
2012/0129396 A1* 5/2012 Wang ..... H01R 12/515 439/607.01
2012/0149255 A1* 6/2012 Wang ..... H01R 9/038 439/725
2012/0164860 A1* 6/2012 Wang ..... G02B 6/4261 439/159
2012/0171903 A1* 7/2012 Wang ..... H01R 13/508 439/660
2012/0190223 A1* 7/2012 Wu ..... H01R 13/633 439/152
2012/0190224 A1* 7/2012 Wu ..... H01R 13/633 439/157
2012/0208405 A1* 8/2012 Wang ..... H01R 12/716 439/676
2012/0214324 A1* 8/2012 Wu ..... H01R 13/6658 439/271
2012/0214345 A1* 8/2012 Wu ..... H01R 13/6583 439/607.19
2012/0214350 A1* 8/2012 Wu ..... H01R 13/5812 439/676
2012/0218720 A1* 8/2012 Wu ..... H01R 13/6275 361/740
2012/0220152 A1* 8/2012 Wu ..... H01R 13/6335 439/350
2012/0282790 A1* 11/2012 Wang ..... H01R 13/6335 439/153
2013/0095676 A1* 4/2013 Wu ..... H01R 9/2408 439/76.1
2013/0109242 A1* 5/2013 Li ..... H01R 12/53 439/660
2013/0231011 A1* 9/2013 Sytsma ..... H01R 9/034 439/723
2013/0273766 A1* 10/2013 Lindkamp ..... H01R 13/50 439/345
2013/0288507 A1* 10/2013 Zhu ..... H01R 13/62 439/345
2013/0323959 A1* 12/2013 Zhu ..... H01R 13/62 439/353
2014/0035755 A1* 2/2014 Ward ..... G08B 5/00 340/691.1
2014/0120779 A1* 5/2014 Lloyd ..... H01R 12/53 439/660
2014/0134898 A1* 5/2014 Wang ..... H01R 13/6275 439/843
2014/0154921 A1* 6/2014 Qi ..... H01R 13/6581 439/620.03
2014/0206230 A1* 7/2014 Rost ..... H01R 9/032 439/607.01
2014/0322933 A1* 10/2014 Li ..... H01R 13/5845 439/76.1
2014/0322984 A1* 10/2014 Wu ..... H05K 1/0298 439/660
2014/0349496 A1* 11/2014 Zhu ..... H05K 1/0219 439/108
2015/0031245 A1* 1/2015 Wu ..... H01R 13/6473 439/638
2015/0031246 A1* 1/2015 Wu ..... H01R 13/6473 439/660
2015/0111402 A1* 4/2015 Hackman ..... H01R 13/648 439/98
2015/0187461 A1* 7/2015 Potterf ..... H01R 12/7076 174/76
2015/0270649 A1* 9/2015 Blazek ..... H01R 13/6599 439/607.02
2015/0318634 A1* 11/2015 Henry ..... H01R 9/034 439/676
2015/0318642 A1* 11/2015 Lee ..... H01R 13/506 439/607.05
2016/0064873 A1* 3/2016 Bucher ..... H01R 12/7076 385/88
2016/0126660 A1* 5/2016 Henry ..... H01R 13/506 439/606
2016/0149341 A1* 5/2016 Reed ..... H01R 13/6275 439/352
2016/0294114 A1* 10/2016 Nonen ..... H01R 13/6273
2016/0344143 A1* 11/2016 Guo ..... H01R 13/6275
2017/0040746 A1* 2/2017 Zhang ..... H01R 12/594
2017/0294739 A1* 10/2017 Pao ..... H01R 12/53
2017/0352452 A1* 12/2017 Nonen ..... H01B 3/305
2018/0074273 A1* 3/2018 Wang ..... G02B 6/4261

* cited by examiner

SFP CABLE CONNECTOR CAPABLE OF PROTECTING SOLDER JOINTS

CROSS-REFERENCE TO RELATED APPLICATIONS

Benefit is claimed to Chinese Patent Application No. 201710896837.2, filed Sep. 29, 2017, the contents of which are incorporated by reference herein in their entirety.

BACKGROUND OF THE INVENTION

Field of the Invention

The present invention relates to a connector technology, and more particularly to an SFP cable connector capable of protecting solder joints.

Description of the Prior Art

An SFP (Small Form-factor Pluggable) cable connector mainly includes an upper case, a lower case, a circuit board mounted in the lower case, and a cable connected to the circuit board.

Please refer to Chinese patent publication No. CN202362501U, which discloses a QSFP module structure, and FIG. 7 of which discloses that a copper cable (11) is welded onto a circuit board (5), and placed into a base (4), and then fixed by a cable clip (10) to prevent the copper cable (11) from being accidentally pulled out.

However, the above fixed mode by way of the above cable clip (10) provides only an indirect protective effect for welding (or solder joints) between the copper cable (11) and the circuit board (5). When the QSFP module structure is subjected to vibration or other external collision, the circuit board located in the base will sway slightly. This will affect the solder joints between the copper cable and the circuit board, and thus further affect the quality of signal transmission.

Hence, the prior fixed mode cannot provide reliable protect for the solder joints between the copper cable and the circuit board. It is necessary to provide a new SFP cable connector being capable of pre-pressing the solder joints and protecting directly the solder joints.

BRIEF SUMMARY OF THE INVENTION

A primary object of the present invention is to provide an SFP cable connector capable of protecting solder joints, which can protect directly the solder joints to prevent the solder joints between the cable and the circuit board from being damaged and to further ensure the product quality of the cable connector.

Other objects and advantages of the present invention may be further understood from the technical features disclosed by the present invention.

To achieve the aforementioned object or other objects of the present invention, the present invention adopts the following technical solution.

The present invention provides an SFP cable connector capable of protecting solder joints comprises a lower case having a lower receiving cavity, a cable, one end of which extends into the lower receiving cavity and the other end of which extends out of the lower case, a circuit board being fixed in the lower receiving cavity of the lower case and being soldered with the one end of the cable to form a plurality of solder joints on the circuit board, an insulator being formed on the top of the circuit board and covering all the solder joints; and an upper case being mounted on the lower case and forming an upper receiving cavity and a protruding shoulder with an end surface; wherein the protruding shoulder extends downward from the top of the upper receiving cavity, and the end surface of the protruding shoulder is capable of pressing the insulator downward firmly.

In one embodiment, the lower case has an insertion end at the front, a holding end at the rear and two parallel lower sidewalls; the lower receiving cavity is defined between the two lower sidewalls; the insertion end forms an insertion opening; and the holding end forms a pair of lower retaining holes; and the upper case has a front end, a rear end and two parallel upper sidewalls; the upper receiving cavity is defined between the two upper sidewalls; and the rear end forms a pair of upper retaining holes; when the upper case is mounted on the lower case, the front end and the insertion end are combined together, the rear end and the holding end are combined together, and a pair of fasteners pass through the corresponding upper and lower retaining holes for fixing the upper case onto the lower case.

In one embodiment, the lower case further has a pair of positioning protrusions, which are formed on the two lower sidewalls and are protruding toward the lower receiving cavity; the circuit board further forms two cuts on two sides thereof, which can be engaged with the two positioning protrusions for fixing the circuit board in the lower case.

In one embodiment, the circuit board includes one row of conductive pads formed on the top of the circuit board and at the front of the circuit board, and one row of solder pads formed on the top of the circuit board and in rear of the conductive pads.

In one embodiment, the one end of the cable is a fixed end extending into the lower receiving cavity of the lower case, and the other end of the cable is a free end extending out of the lower case; the cable further has a multiple of conductors extending forward from the fixed end and being soldered onto the solder pads to form the solder joints on the top of the circuit board.

In one embodiment, the insulator has a top surface and a horizontal bottom surface; the insulator is directly formed on the top of the circuit board; and the horizontal bottom surface of the insulator covers all the solder joints of the circuit board.

In one embodiment, the top surface of the insulator is step-like and is divided into an upper horizontal plane and a lower horizontal plane.

In one embodiment, the end surface of the protruding shoulder is horizontal to press the lower horizontal plane of the top surface of the insulator downward.

In one embodiment, the SFP cable connector further includes a grounding shell, which surrounds and is fixed on the upper case and the lower case, and further includes a locking and unlocking mechanism mounted on the lower case.

In one embodiment, the pair of fasteners are screws.

In comparison with the prior art, the SFP cable connector of the present invention disposes the insulator (or the plastic body) at the solder joints, and disposes the protruding shoulder on the upper case. The protruding shoulder can press the insulator downward firmly, so that all the solder joints can be directly protected against damage.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Please refer to FIGS. 1 to 7, an SFP cable connector 1 of the present invention is used to connect motherboards and fiber of network devices, such as switches, routers and other equipment.

Figure 1:
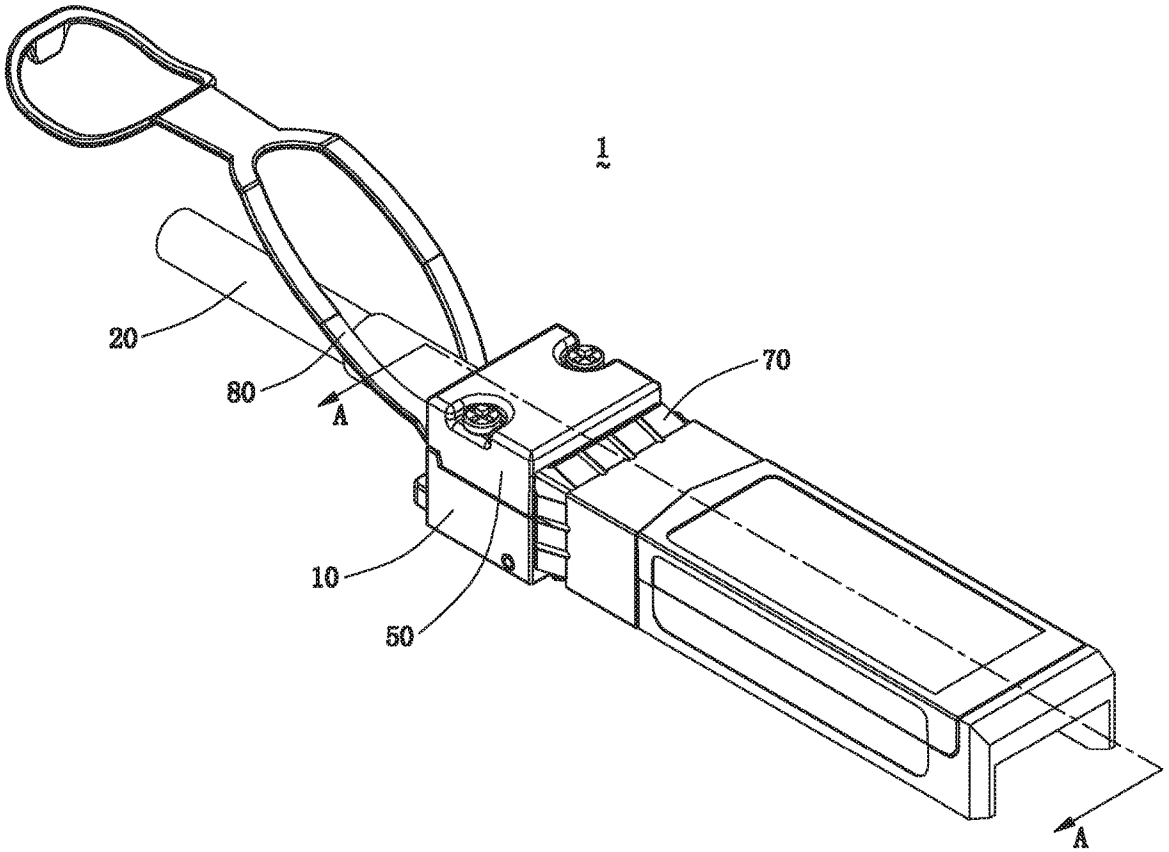
FIG. 1 is a perspective schematic view of an SFP cable connector of the present invention.
Figure 2:
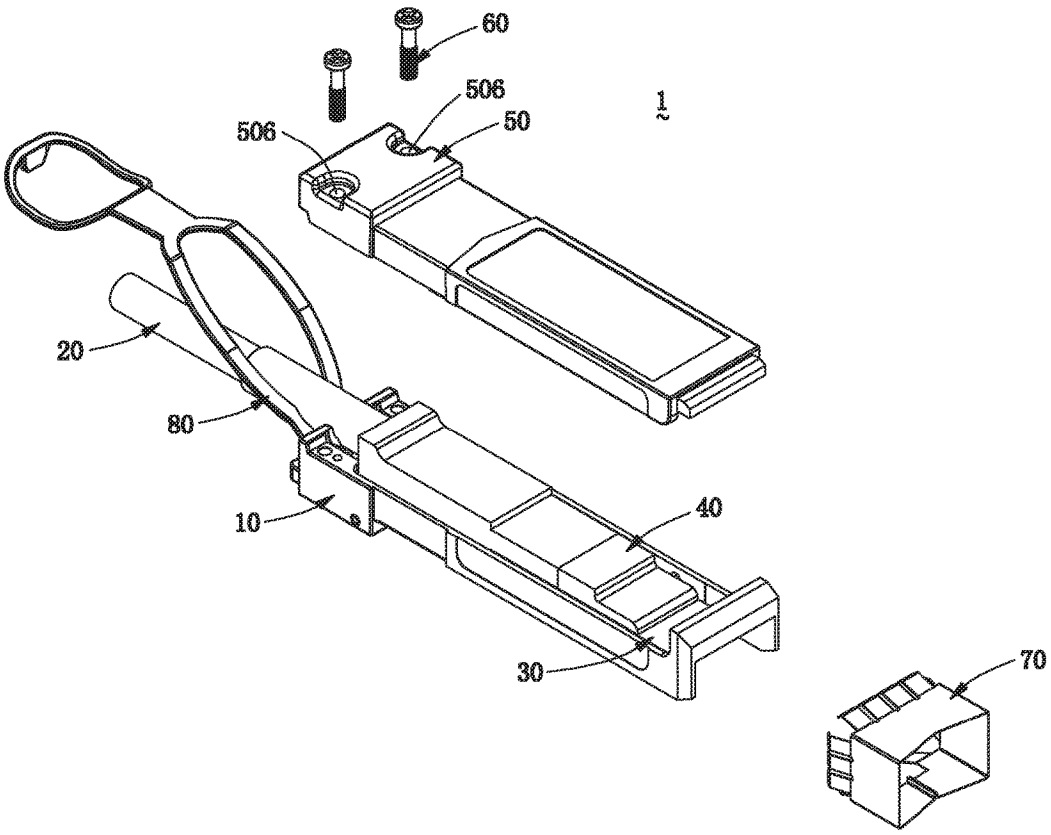
FIG. 2 is an exploded view of the SFP cable connector shown in FIG. 1, wherein a grounding shell and an upper case are disassembled.
Figure 3:
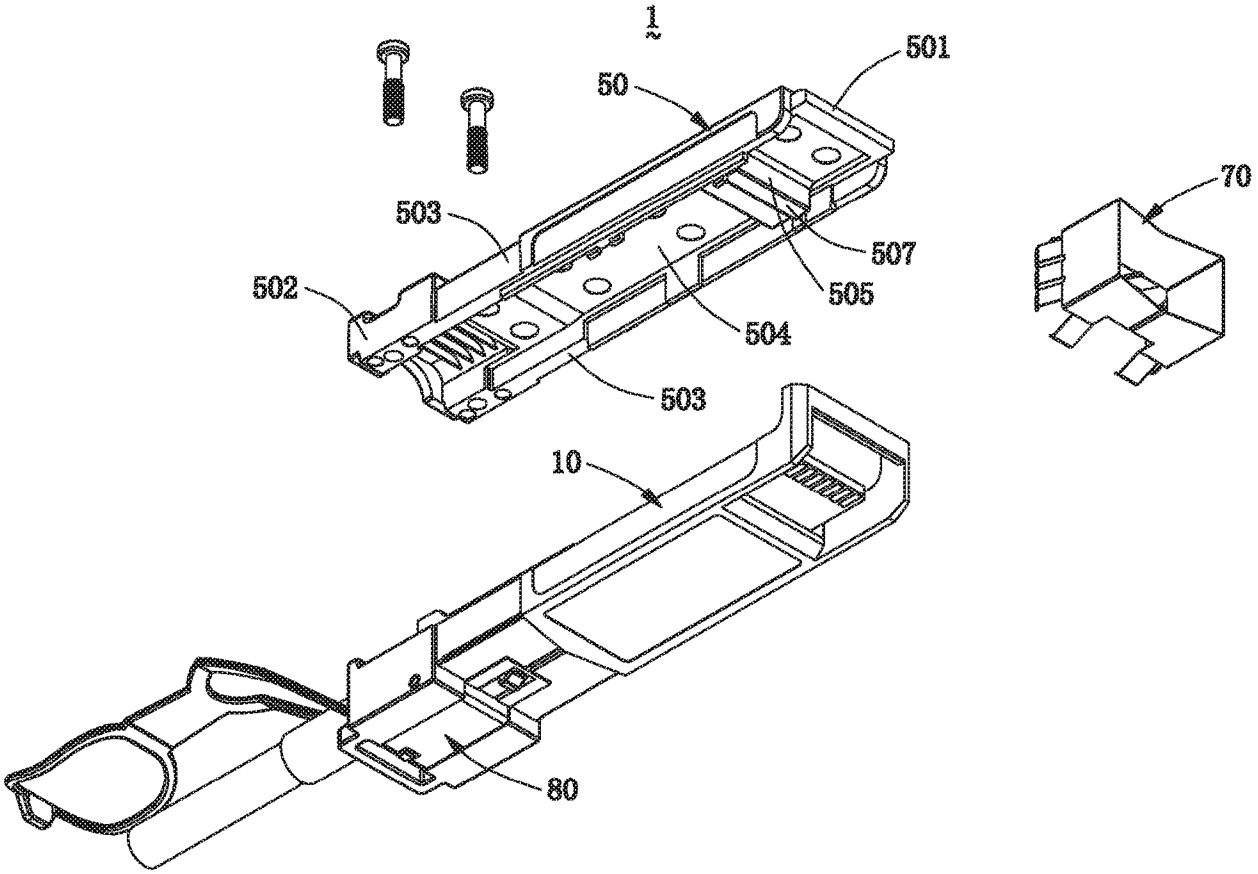
FIG. 3 is another schematic view of the SFP cable connector shown in FIG. 2 along another direction.

As shown in FIGS. 1, 2 and 3, the SFP cable connector 1 of the present invention mainly comprises a lower case 10, a cable 20 extended into the lower case 10, a circuit board 30 fixed in the lower case 10 and connected to the cable 20, an insulator 40 located on the circuit board 30, and an upper case 50 being mounted on the lower case 10 and pressing the insulator 40 downward.

Figure 6:
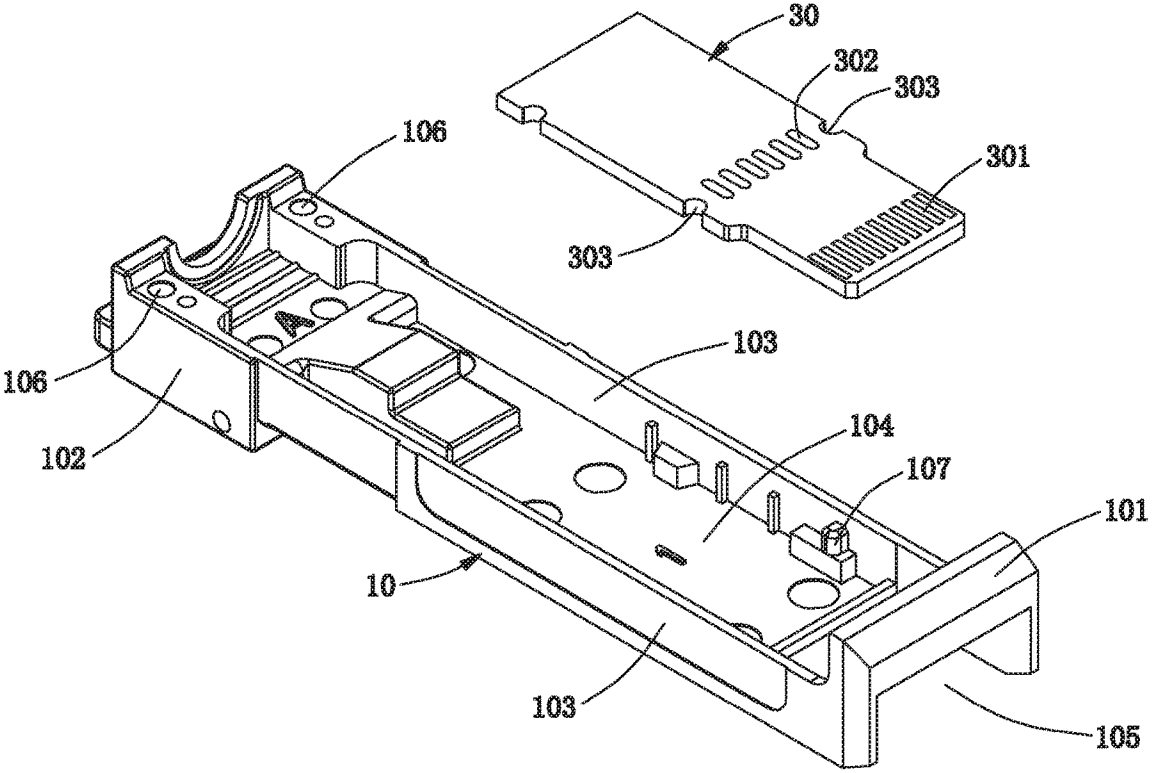
FIG. 6 shows the circuit board and the lower case of the SFP cable connector of the present invention.

As shown in FIG. 6, the lower case 10 has an insertion end 101 at the front, a holding end 102 at the rear, two parallel lower sidewalls 103, and a lower receiving cavity 104 formed between the two lower sidewalls 103. In the embodiment, the insertion end 101 of the lower case 10 forms an insertion opening 105 for being used to dock with an external module (not shown). The holding end 102 forms a pair of lower retaining holes 106, and a pair of fasteners 60 (shown in FIG. 2) can pass through the corresponding lower retaining holes 106 for fixing the upper case 50 onto the lower case 10. The lower case 10 further has a pair of positioning protrusions 107, which are formed on the two lower sidewalls 103 and are protruding toward the lower receiving cavity 104 for being used to fix the circuit board 30. In the embodiment, the pair of fasteners 60 are screws.

Figure 5:
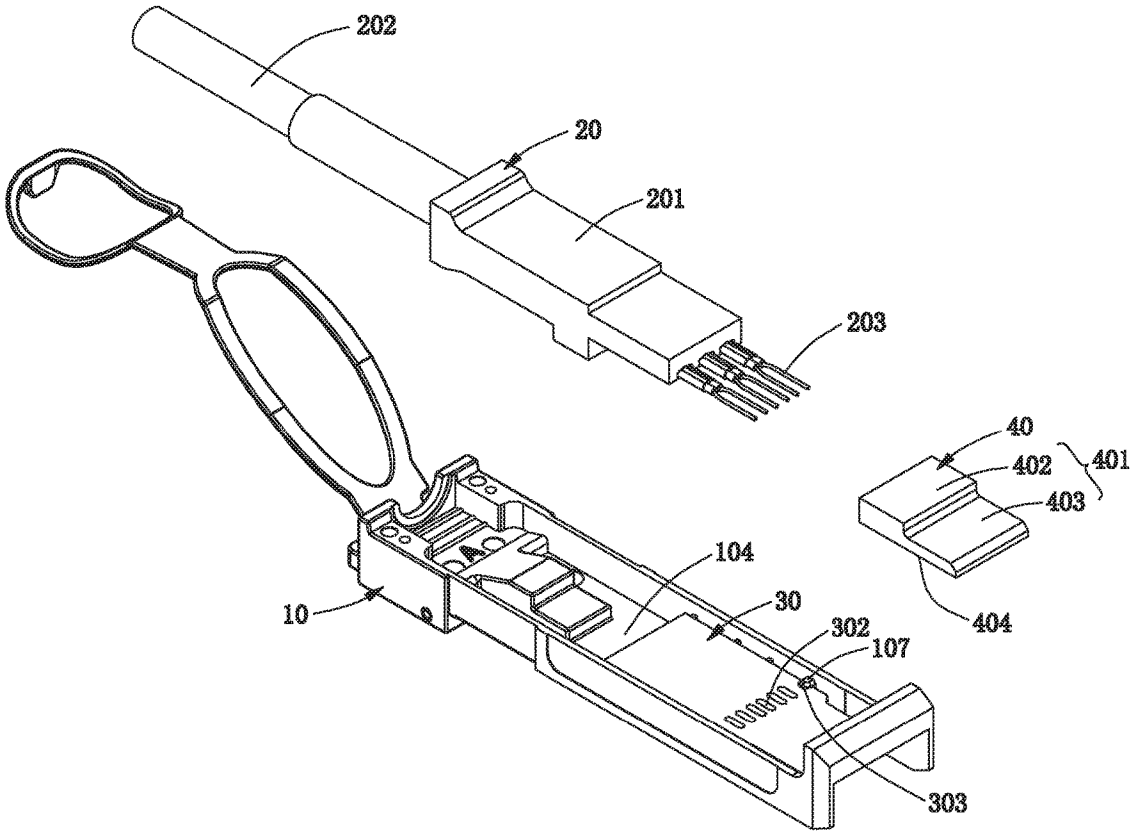
FIG. 5 is a disassembly schematic view of partial structures of the SFP cable connector, which mainly shows the position relationship of the circuit board and a lower case.

As shown in FIG. 6, the circuit board 30 includes one row of conductive pads 301 (or gold fingers) formed on the top of the circuit board 30 and at the front of the circuit board 30, and one row of solder pads 302 formed on the top of the circuit board 30 and in rear of the conductive pads 301. In the embodiment, the circuit board 30 further forms the other row of conductive pads on the bottom of the circuit board 30. The two rows of conductive pads 301 are used to form electrical connections with the external module, and the row of solder pads 302 are used to be soldered with the cable 20. The circuit board 30 further forms two cuts 303 on two sides thereof. As shown in FIG. 5, when the circuit board 30 is placed into the lower receiving cavity 104 of the lower case 10, the positioning protrusions 107 of the lower case 10 can fit into the corresponding cuts 303 of the circuit board 30, so the circuit board 30 is fixed in the lower receiving cavity 104 of the lower case 10.

Figure 4:
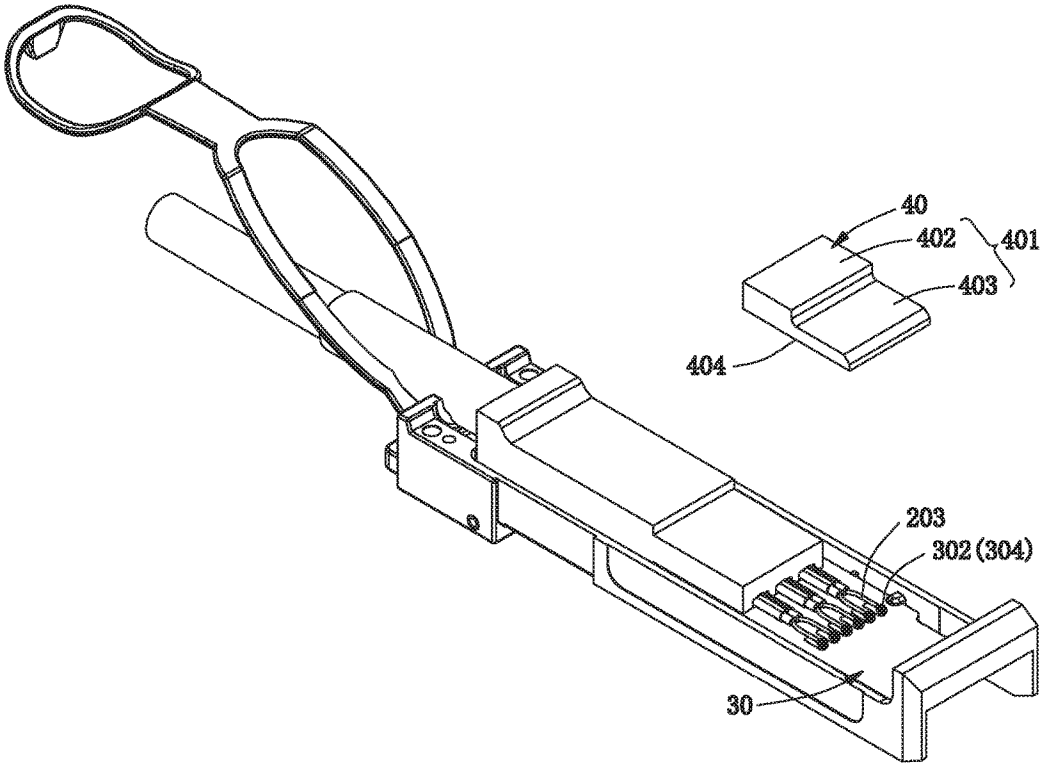
FIG. 4 is a disassembly schematic view of partial structures of the SFP cable connector, which mainly shows the position relationship of a cable and a circuit board.

Referring to FIG. 5, the cable 20 has a fixed end 201 extending into the lower receiving cavity 104 of the lower case 10, a free end 202 extending out of the lower case 10, and a plurality of conductors 203 extending forward from the fixed end 201. As shown in FIG. 4, these conductors 203 can be soldered onto the solder pads 302 to form a plurality of solder joints 304 on the top of the circuit board 30.

Referring to FIGS. 4 and 5, the insulator 40 has a top surface 401 and a horizontal bottom surface 404. In the embodiment, the insulator 40 is a plastic body formed by the process of filling at the solder joints 304 of the circuit board 30. In the embodiment, the top surface 401 is step-like and has two stairs, which divide the top surface 401 into an upper horizontal plane 402 and a lower horizontal plane 403. But in other embodiments, the top surface 401 may form more stairs according to actual demand, or have no stair, or form a depression part thereon.

Referring to FIGS. 2 and 4, the insulator 40 is directly formed on the top of the circuit board 30. The horizontal bottom surface 404 of the insulator 40 covers all the solder joints 304 of the circuit board 30. Moreover, when assembled, the circuit board 30, all of the conductors 203 being soldered together with the circuit board 30 and the insulator 40 covering the solder joints 304 are all placed into the lower receiving cavity 104 (label seen in FIG. 6) of the lower case 10.

Please refer to FIG. 3, the upper case 50 has a construction similar to the lower case 10. The upper case 50 has a front end 501, a rear end 502, two parallel upper sidewalls 503 and an upper receiving cavity 504 formed between the two upper sidewalls 503. The upper case 50 further has a protruding shoulder 505 extending downward from the top of the upper receiving cavity 504 to be used to press the insulator 40 (label seen in FIG. 2) downward.

Please refer to FIG. 2, the rear end 502 forms a pair of upper retaining holes 506. The pair of fasteners 60 can pass through the corresponding upper retaining holes 506 firstly and then pass through the corresponding lower retaining holes 106 (label seen in FIG. 6) for fixing the upper case 50 onto the lower case 10.

Referring to FIG. 3, in the embodiment, the protruding shoulder 505 has a horizontal end surface 507. Of course, in other embodiments, the shape of the end surface 507 may be modified according to the shape of the top surface 401 of the insulator 40. For example, the end surface 507 may be step-like for matching with the stepped top surface 401 of the insulator 40 and pressing the insulator 40 downward.

Figure 7:
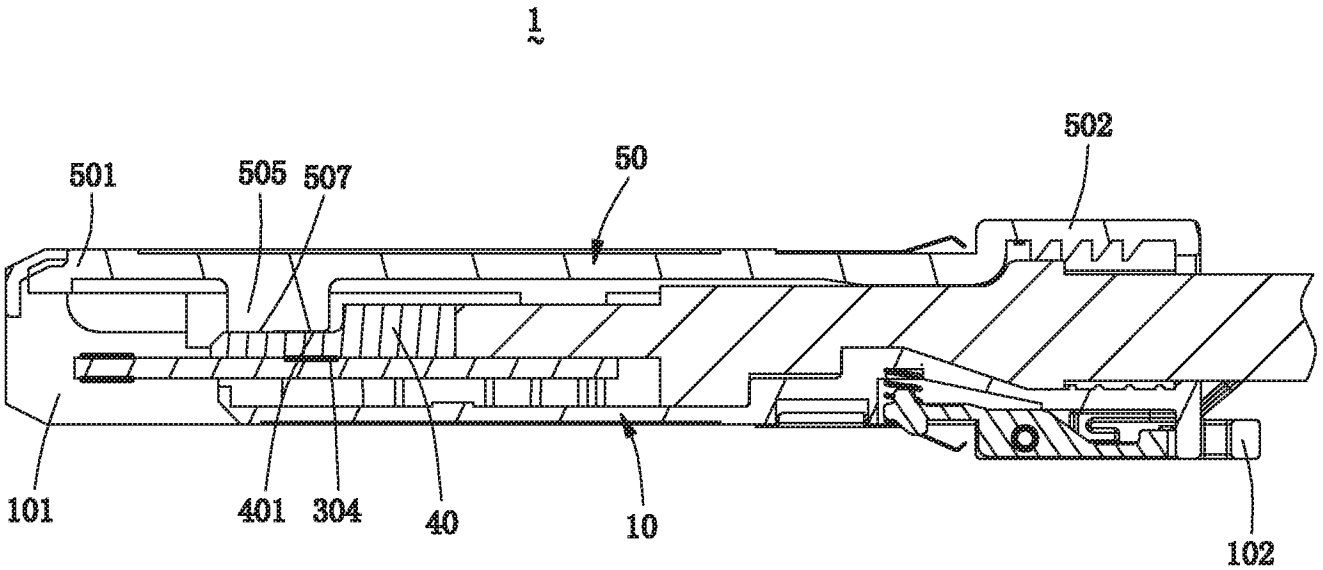
FIG. 7 is a longitudinal section view of the SFP cable connector along a line A-A of FIG. 1.

Referring to FIG. 7, when the upper case 50 is mounted on the lower case 10, the front end 501 and the insertion end 101 are combined together, the rear end 502 and the holding end 102 are combined together, and the end surface 507 of the protruding shoulder 505 presses the lower horizontal plane 403 of the top surface 401 of the insulator 40 for forming a stable engaging structure. When the upper case 50 is fixed on the lower case 10 by the pair of fasteners 60, the insulator 40 can be firmly pressed by the protruding shoulder 505, thereby providing a direct protection for all the solder joints 304.

Please refer to FIGS. 1 to 3, the SFP cable connector 1 further includes a grounding shell 70 surrounding and being fixed on the upper case 50 and the lower case 10, and a locking and unlocking mechanism 80 mounted on the lower case 10.

As described above, the SFP cable connector 1 of the present invention employs the protruding shoulder 505 to press the insulator 40 downward thereby providing a direct protection for all the solder joints 304 to prevent the solder joints 304 from being damaged and ensure the SFP cable connector's quality.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An SFP cable connector capable of protecting solder joints, comprising:

a lower case having a lower receiving cavity;

a cable, one end of which extends into the lower receiving cavity and the other end of which extends out of the lower case;

a circuit board being fixed in the lower receiving cavity of the lower case and being soldered with the one end of the cable to form a plurality of solder joints on the circuit board;

an insulator being formed on the top of the circuit board and covering all the solder joints; and an upper case being mounted on the lower case and forming an upper receiving cavity and a protruding shoulder with an end surface;

wherein the protruding shoulder extends downward from the top of the upper receiving cavity, and the end surface of the protruding shoulder is capable of pressing the insulator downward firmly; and the insulator has a top surface and a horizontal bottom surface; the insulator is directly formed on the top of the circuit board; and the horizontal bottom surface of the insulator covers all the solder joints of the circuit board.

2. The SFP cable connector as claimed in claim 1, wherein the lower case has an insertion end at the front, a holding end at the rear and two parallel lower sidewalls; the lower receiving cavity is defined between the two lower sidewalls; the insertion end forms an insertion opening; and the holding end forms a pair of lower retaining holes; and the upper case has a front end, a rear end and two parallel upper sidewalls; the upper receiving cavity is defined between the two upper sidewalls; and the front rear end forms a pair of upper retaining holes;

when the upper case is mounted on the lower case, the front end and the insertion end are combined together, the rear end and the holding end are combined together, and a pair of fasteners pass through the corresponding upper and lower retaining holes for fixing the upper case onto the lower case.

3. The SFP cable connector as claimed in claim 1, wherein the lower case further has a pair of positioning protrusions, which are formed on the two lower sidewalls and are protruding toward the lower receiving cavity;

the circuit board further forms two cuts on two sides thereof, which can be engaged with the two positioning protrusions for fixing the circuit board in the lower case.

4. The SFP cable connector as claimed in claim 1, wherein the circuit board includes one row of conductive pads formed on the top of the circuit board and at the front of the circuit board, and one row of solder pads formed on the top of the circuit board and in rear of the conductive pads.

5. The SFP cable connector as claimed in claim 1, wherein the one end of the cable is a fixed end extending into the lower receiving cavity of the lower case, and the other end of the cable is a free end extending out of the lower case;

the cable further has a multiple of conductors extending forward from the fixed end and being soldered onto the solder pads to form the solder joints on the top of the circuit board.

6. The SFP cable connector as claimed in claim 1, wherein the top surface of the insulator is step-like and is divided into an upper horizontal plane and a lower horizontal plane.

7. The SFP cable connector as claimed in claim 1, wherein the end surface of the protruding shoulder is horizontal to press the lower horizontal plane of the top surface of the insulator downward.

8. The SFP cable connector as claimed in claim 1, wherein further including a grounding shell, which surrounds and is fixed on the upper case and the lower case, and further including a locking and unlocking mechanism mounted on the lower case.

9. The SFP cable connector as claimed in claim 2, wherein the pair of fasteners are screws.

* * * * *